US005158030A

United States Patent [19]

DuBois et al.

[11] Patent Number: 5,158,030

[45] Date of Patent: Oct. 27, 1992

[54] DAMPED FLEXIBLE SEAL

[75] Inventors: Neil J. DuBois, Cranston; Antonio M. Amaral, Barrington, both of R.I.

[73] Assignee: The United States of America as represented by the Secretary of the Navy, Washington, D.C.

[21] Appl. No.: 876,713

[22] Filed: Mar. 22, 1992

[51] Int. Cl.[5] ..... B63H 21/08

[52] U.S. Cl. ..... 114/20.1; 248/580; 277/97; 277/DIG. 9; 384/222

[58] Field of Search ..... 248/580, 603; 384/222, 384/536, 582, 140, 482; 277/37, 47, 48, 51, 58, 97, 100, 214, DIG. 9; 181/0.5; 367/191.1; 114/20.1, 20.2, 22

[56] References Cited

U.S. PATENT DOCUMENTS

| | | | |
|---|---|---|---|
| 2,166,259 | 7/1939 | Meyer | 384/222 |
| 2,977,919 | 4/1961 | Blake | 114/20.1 |
| 3,139,056 | 6/1964 | Boswell et al. | 114/22 |
| 4,668,110 | 5/1987 | Egeto et al. | 384/536 |
| 4,755,154 | 7/1988 | Ewbank | 440/52 |
| 5,040,764 | 8/1991 | DuBois | 248/603 |

*Primary Examiner*—Brian S. Steinberger
*Attorney, Agent, or Firm*—Michael J. McGowan; Prithvi C. Lall; Michael F. Oglo

[57] ABSTRACT

A damped flexible seal assembly for a torpedo isolates the tailcone thereof from vibrational energy present in the drive shaft assembly. A pair of outside flanges, each of which include an inwardly facing groove and an O-ring constrained therein, provide a watertight seal against the outer non-rotating surface of the drive shaft assembly. An inside flange includes an outwardly-facing groove and an O-ring constrained therein, and provides a watertight seal against the inner surface of the tail cone. Two cast-in-place elastomeric seals provide a watertight seal between the flanges and further provide a damping barrier between the outside flanges and the inside flanges for damping vibrational energy present in the drive shaft assembly before the energy can reach the tailcone through the seal assembly.

6 Claims, 1 Drawing Sheet

DAMPED FLEXIBLE SEAL

STATEMENT OF GOVERNMENT INTEREST

The invention described herein may be manufactured and used by or for the Government of The United States of America for governmental purposes without the payment of any royalties thereon or therefore.

BACKGROUND OF THE INVENTION (1) Field of the Invention

The instant invention relates to vibrational and acoustical damping in underwater vehicles and more particularly relates to a damped flexible seal assembly for the drive shaft of a torpedo.

(2) Description of the Prior Art

The use of flexible materials for vibration damping purposes in watercraft has heretofore been known in the art. In this regard, the U.S. Pat. Nos. 3,139,056 to Boswell et al; 4,755,154 to Eubank; and 4,756,264 also to Eubank represent the closest prior art to the instant invention of which the applicant is aware. The Boswell patent discloses a torpedo having an acoustically isolated nose section wherein a rubber-like material is disposed between the nose section and the body of the torpedo. Similarly, the U.S. Pat. Nos. 4,756,264, and 4,755,154 to Eubank disclose noise damping systems for torpedoes wherein a layer of elastomeric material is utilized to provide acoustic attenuation between parts in a torpedo.

The use of flexible materials for sealing rotating drive shafts in watercraft is also known in the art. The U.S. Pat. No. 4,732,396 to Brinham is representative of apparatus incorporating flexible sealing materials.

Many state of the art watercraft, including torpedoes, are currently being designed with drive shaft assemblies which have an inner rotating drive shaft and an outer non-rotating surface. In these types of designs a primary water seal is included between the outer non-rotating surface of the drive shaft assembly and the inner mating surface of the torpedo tailcone. It has been found that this seal, while providing a watertight barrier, also provides a direct coupling path for transferring vibrational energy from the propulsion motor and/or drive shaft assembly to the tailcone, which has been shown to be an efficient acoustic radiator. Hence, it has been determined that there is a need for a seal which provides a mechanical sealing function as well as a damping function for isolating the tailcone from vibratory energy present in the drive shaft.

SUMMARY OF THE INVENTION

The instant invention provides a damped flexible seal assembly for a drive shaft assembly of a torpedo. The seal assembly effectively forms a watertight seal between a stationary outside surface of the drive shaft assembly and an inside mating surface of a tailcone of the torpedo, and isolates the tailcone from vibrational energy present in the drive shaft. The flexible seal assembly includes a pair of annular outside flanges, an annular inside flange, and two annular, cast-in-place, elastomeric seals which are positioned between the outside flanges and the inside flange. The outside flanges each include an inwardly facing groove and an O-ring constrained therein for providing a watertight seal against the outer surface of the sealing tube of the drive shaft assembly. The inside flange includes an outwardly-facing groove and an O-ring constrained therein for providing a watertight seal against the inner surface of the tailcone. The elastomeric seals provide a watertight, yet flexible barrier between the flanges, while also providing a damping barrier between the outside flanges and the inside flange for damping vibrational energy present in the drive shaft assembly before it can reach the tailcone through the seal assembly. Accordingly, it is an object of the instant invention to provide a mechanical seal for the drive shaft of a torpedo.

It is another object to provide a flexible seal which effectively forms a watertight seal between the outside surface of the drive shaft assembly and the inside surface of the tailcone of the torpedo.

It is yet another object to provide a damped seal which isolates the tailcone from vibrational energy present in the drive shaft.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENTS

Figure 1:
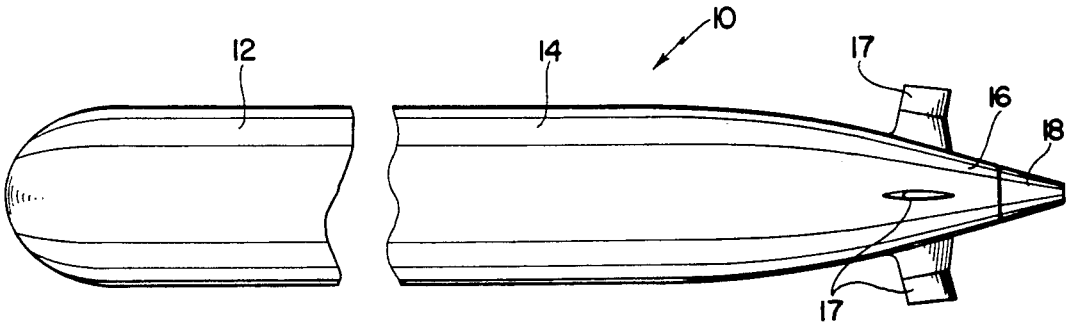
FIG. 1 is an elevational view of a torpedo incorporating the instant invention.
Figure 2:
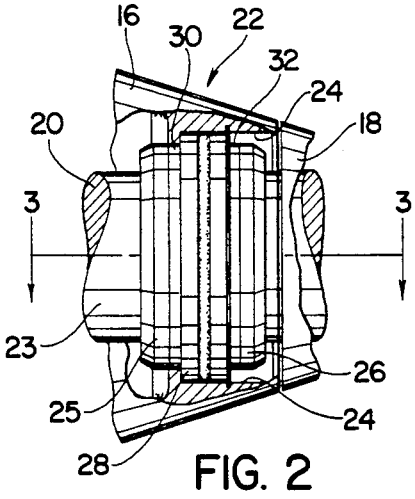
FIG. 2 is a fragmentary, enlarged cut-away view of the damped flexible seal of the instant invention.
Figure 3:
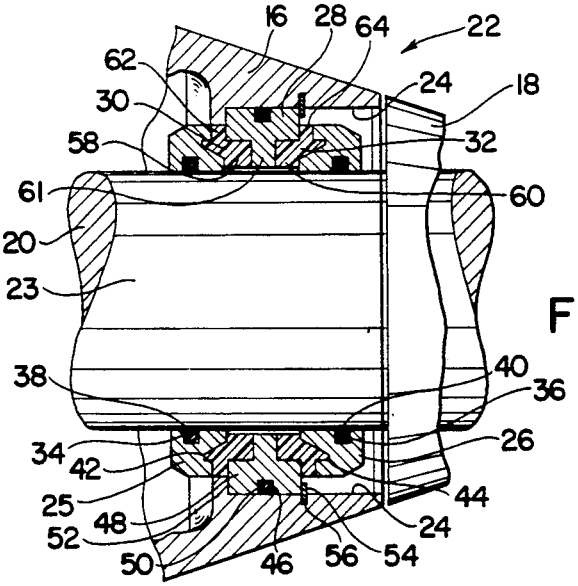
FIG. 3 is a further enlarged cross-sectional view thereof taken along line 3—3 of FIG. 2.

Referring now to the drawings, and particularly to FIG. 1, there is illustrated a torpedo generally indicated at 10 which comprises a nose section 12, an afterbody 14, a tailcone section 16 having four circumferentially spaced directional fins 17, and a tail cap 18. The damped flexible seal assembly of the instant invention is incorporated into the tailcone section 16 of the torpedo 10. In FIG. 2 there is illustrated an enlarged cut-away section of the tailcone 16 showing the drive shaft assembly 20 of the torpedo 10 and the damped flexible seal assembly of the instant invention generally indicated at 22. The seal assembly 22 provides a waterproof barrier between the outside non-rotating surface 23 of the drive shaft assembly 20 and the inside mating surface 24 of the tailcone 16. It is pointed out that the seal assembly 22 and its mating surfaces 23 and 24 are non-rotating. Bearings for the rotating drive shaft are mounted inside the drive shaft assembly 20, the outside surface 23 thereof being stationary. During operation of the torpedo 10, vibrations caused by either the propulsion motor or the propellers of the torpedo 10 are transmitted into the drive shaft assembly 20. The damped flexible seal assembly 22 of the instant invention effectively attenuates these vibrations prior to their reaching the tailcone 16 and thereby radiating into the surrounding medium. This advantage can more readily be appreciated by reference to FIG. 3 which illustrates a cross-sectional view of the seal assembly 22.

The damped flexible seal assembly 22 comprises a pair of annular outside flanges 25 and 26, an annular T-shaped inside flange 28, and two annular cast-in-place elastomeric seals 30 and 32. The outside flanges 25 and 26 are preferably fashioned from aluminum and each includes an inwardly-facing groove, 34 and 36 respectively, and an O-ring, 38 and 40 respectively, constrained therein for forming a waterproof seal against the outside surface 23 of the drive shaft assembly 20. The outside flange 25 and 26 further includes V-shaped notches 42 and 44 which are respectively formed on the inner faces thereof. The inside flange 28 is also preferably fashioned from aluminum and it includes an outwardly-facing groove 46 in the cross portion 48 thereof and an O-ring 50 constrained therein for forming a waterproof seal against the inner mating surface 24 of the tailcone section 16. The flanges are specifically arranged so that the outside flanges 25 and 26 only contact the surface 23 of the drive shaft 20, and inside flange 28 only contacts the inside surface 24 of the tailcone 16. The inside flange 28 is maintained in position by means of a flange 52 depending inwardly from inner-tailcone surface 24 and a retaining ring 54 which is disposed in a groove 56 in the inside surface 24 of the tailcone 16. Although the flanges 25, 26, and 28, are fashioned from aluminum in the preferred embodiment, the flanges may be fashioned from other lightweight materials depending on the required performance and operating conditions of the application. The elastomeric seals 30 and 32 are preferably cast-in-place from a flexible elastomer material, such as polyurethane, and each includes an annular ring portion 58 and 60 respectively, which matingly engage with the grooves 42 and 44 of the outside flanges 25 and 26, and the upright portion 61 of the inside flange 28, and separate the flanges from each other. The seals 30 and 32 further include upwardly depending flange portions 62 and 64 which further separate the outside flanges 25 and 26 from the inside flange 28. In this regard, it is pointed out that the inside flange 28 is suspended on top of the seals 30 and 32 so as not to contact the outside surface 23 of the drive shaft assembly. The seals 30 and 32 of the preferred embodiment are cast from "HEXCEL Uralite 3130". The seals 30 and 32 provide a waterproof yet flexible barrier while also providing a damping barrier between the outside flanges 25, 26 (which contact the drive shaft assembly 20), and the inside flange 28 (which contacts the tailcone 16). During operation of the torpedo, vibrational energy present in the drive shaft 20 is passed to the outside flanges 25 and 26 and into the flexible elastomeric seals 30 and 32, where the energy is attenuated before it can pass into the inside flange 28 and into the tailcone 16. In this regard, the flexible, elastomeric seals 30 and 32 effectively damp any vibrational energy present in the drive shaft assembly 22 before it reaches the tailcone 16. Although the elastomeric seals 30 and 32 are preferably fashioned from polyurethane, any one of a variety of commercially available cast-in-place elastomers can also be utilized depending on the required performance and operating conditions of the application.

Although the flexible seal assembly 22 of the instant invention has been described for use in the drive shaft assembly of a torpedo, it can be appreciated that the seal assembly can be utilized in any type of underwater vehicle which requires a damped flexible seal for concentric non-rotating circular elements.

It can therefore be seen that the instant invention provides a effective damped flexible seal for the drive shaft of a torpedo. The seal provides both a mechanical sealing function and a damping function for damping vibrational energy present in the drive shaft. The seal assembly effectively attenuates the vibrational energy before it reaches the tailcone and therefore decreases acoustical noise which can radiate outwardly into the surrounding medium through the tailcone. For all of these reasons, it is believed that the damped flexible seal assembly of the instant invention represents significant advancements in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A seal assembly for concentric non-rotating cylindrical elements comprising:

a pair of annular metallic outside flanges each of which include inwardly-facing sealing means for forming a watertight seal against an outer surface of an inner cylindrical element;

an inside annular metallic flange which includes outwardly facing sealing means for forming a watertight seal against an inner surface of an outer cylindrical element;

two annular elastomeric seals which are positioned between said outside flanges and said inside flange, and provide a watertight yet flexible barrier therebetween, said elastomeric seals further providing a damping barrier between said outside flanges and said inside flange for damping vibrational energy present in said inner cylindrical element; and and said inner cylindrical element comprising a drive shaft assembly of an underwater vehicle, said outer cylindrical element comprising a tailcone of said underwater vehicle, said elastomeric seals providing a damping barrier between said inside and outside flanges for attenuating vibrational energy present in said drive shaft assembly.

2. In the seal assembly of claim 1 said flanges comprising aluminum.

3. In the seal assembly of claim 1, each said inwardly facing and outwardly facing sealing means comprising a groove and an O-ring constrained therein.

4. In the seal assembly of claim 1, said elastomeric seals comprising a cast-in-place elastomeric material.

5. In the seal assembly of claim 4, said elastomeric material comprising cast-in-place polyurethane.

6. In the seal assembly of claim 1, said underwater vehicle comprising a torpedo.

* * * * *